US005499955A

United States Patent [19]

Becker et al.

[11] Patent Number: 5,499,955

[45] Date of Patent: Mar. 19, 1996

[54] PATIENT SUPPORT FOR USE WITH PARALLEL BARS

[75] Inventors: Danny L. Becker, Kingsley, Iowa; Kevin W. Bork, Sussex; Carl Krippendorf, Milwaukee, both of Wis.

[73] Assignee: Smith & Nephew Rolyan, Inc., Germantown, Wis.

[21] Appl. No.: 275,123

[22] Filed: Jul. 14, 1994

Related U.S. Application Data

[63] Continuation-in-part of Ser. No. 7,151, Jan. 21, 1993, abandoned.

[51] Int. Cl.[6] ..... A61H 3/00

[52] U.S. Cl. ..... 482/51; 482/66; 482/132; 434/255; 472/15

[58] Field of Search ..... 482/41, 51, 66–69, 482/132, 907, 908; 434/255; 297/5; 472/15, 18, 26, 27, 43, 131; 135/67

[56] References Cited

U.S. PATENT DOCUMENTS

| | | | |
|---|---|---|---|
| 875,377 | 12/1907 | Pilia et al. . | |
| 2,077,569 | 4/1937 | Kish | 482/67 |
| 2,812,010 | 11/1957 | Abdallah . | |
| 2,819,755 | 1/1958 | Berger et al. . | |
| 3,237,940 | 3/1966 | Johnson . | |
| 3,625,237 | 12/1971 | Wertz | 135/67 |
| 4,307,715 | 12/1981 | Fante . | |
| 4,529,194 | 7/1985 | Haaheim | 482/70 |
| 4,676,416 | 6/1987 | Harmon . | |
| 4,890,495 | 1/1990 | Slane | 482/51 |
| 4,948,118 | 8/1990 | Miaglia . | |
| 5,020,560 | 6/1991 | Turbeville | 135/67 |
| 5,024,601 | 6/1991 | Barker . | |
| 5,133,377 | 7/1992 | Truxillo . | |
| 5,174,590 | 12/1992 | Kerley et al. . | |
| 5,224,717 | 7/1993 | Lowen | 482/66 |

FOREIGN PATENT DOCUMENTS

| | | |
|---|---|---|
| 2804346 | 9/1979 | Germany . |
| 960844 | 6/1964 | United Kingdom . |

*Primary Examiner*—Richard J. Apley
*Assistant Examiner*—Jeanne M. Clark
*Attorney, Agent, or Firm*—Pravel, Hewitt, Kimball & Krieger

[57] ABSTRACT

A patient support for use with parallel bars which includes a carriage which is selectively and movably mounted on the upper surface of the parallel bars. The support has a braking mechanism for braking the movement of the support with respect to the parallel bars. The carriage can be transversely adjusted and includes a pair of upstanding adjustable handles which can be grasped by the patient during use.

8 Claims, 17 Drawing Sheets

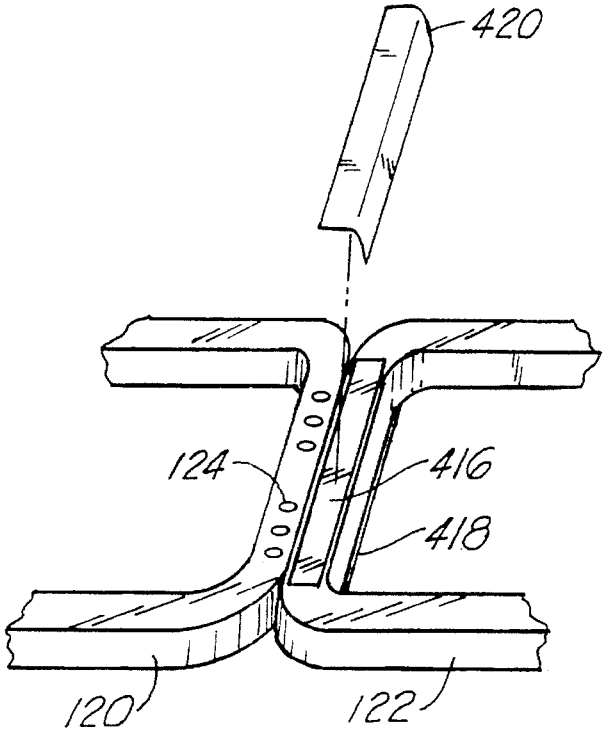
FIG. 19
FIG. 20
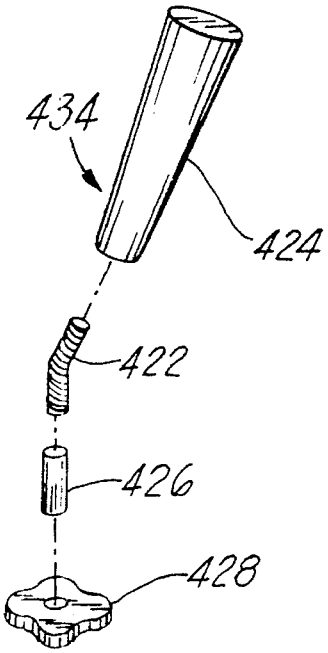
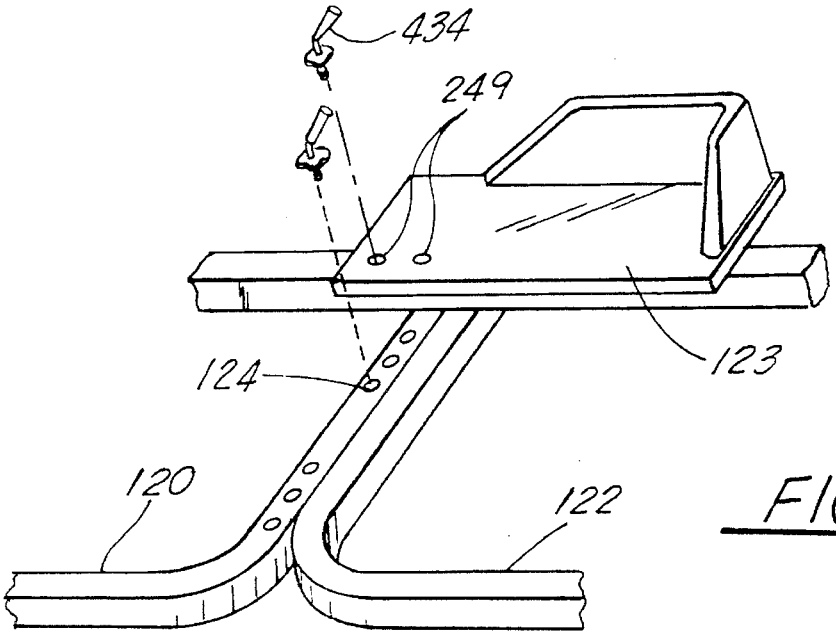
FIG. 21

PATIENT SUPPORT FOR USE WITH PARALLEL BARS

This patent application is a continuation-in-part application of U.S. patent application Ser. No. 007,151 filed Jan. 21, 1993, abandoned.

FIELD OF THE INVENTION

This invention relates to a patient support for use with parallel bars and more particularly to a patient support which is movably positioned on the upper surface of the parallel bars and is adjustable for different sizes of patients.

BACKGROUND OF THE INVENTION

Patients who are going through certain types of therapy and rehabilitation for their legs frequently utilize parallel bars to support themselves during the walking portion of the therapy or rehabilitation. The patient positions herself/himself between the parallel bars and grasps the bars for support during the walking portion of the therapy or rehabilitation. However, in many cases, the patient lacks upper body and arm strength and it is difficult for the patient to sufficiently support herself/himself on the bars during the therapy or rehabilitation.

SUMMARY OF THE INVENTION

A patient support is described for use with a set of parallel bars which enables the patient to support herself/himself between the bars for walking from one end of the bars to the other. The support is comprised of a width adjustable carriage which is movably supported on the parallel bars and which is adopted to guide upon the upper surface as the patient walks between the ends of the parallel bars. The carriage is provided with a pair of upstanding handles for grasping by the patient. The handles are positioned adjacent the forward end of the carriage so that the patient can rest her/his arms on the upper surface of the carriage while grasping the handles.

An auxiliary support board is removably positioned on the upper surface of the carriage to provide additional stability to the patient should the patient so desire. The carriage also includes a brake mechanism to resist the sliding or gliding movement of the carriage along the length of the parallel bars.

In an alternate embodiment, the carriage consists of opposite armrests and the patient rests her/his arms on the upper surface of the armrest which are width adjustable and located on top of a front and back frame. The breaking is accomplished by a variable resistance mechanism at each of the rear wheels, in addition to a separate break arm, in order to offer resistance to the motion of the carriage.

The carriage also includes a torque responsive horizontal bar mechanism on the front legs that prevents users from lifting the carriage off the parallel bars. Padding is included on the crossbars of the carriage for patient protection.

It is therefore a principle object of the invention to provide a patient support for use with parallel bars in which the patient can look downwardly through the support in order to see the floor surface. Another object of the invention is to provide a patient support for use with parallel bars which is adjustable in width so as to be able to be used with a variety of different patients and to also have adjustable upstanding handles for grasping by the patient.

Still another object of the invention is to provide a patient support for use with parallel bars which has a brake mechanism and a mechanism to prevent the support from disengaging from the upper surface of the parallel bars. These and other objects of the present invention will be apparent to those skilled in the art.

BRIEF DESCRIPTION OF THE DRAWINGS

The invention will become more apparent when the detailed description of exemplary embodiments is considered in conjunction with the appended drawings, in which:

FIG. 19 is a perspective view showing the attachment of the padding to the carriage portion of the alternate embodiment of the invention;

FIG. 20 is an exploded perspective view of the assembly of the adjustable handles used for patient grasping;

FIG. 21 is a perspective view of the support illustrating the adjustability of the handles for patient use on the armrest portions of the alternate embodiment of the invention.

DETAILED DESCRIPTION OF PREFERRED EMBODIMENT

Figure 1:
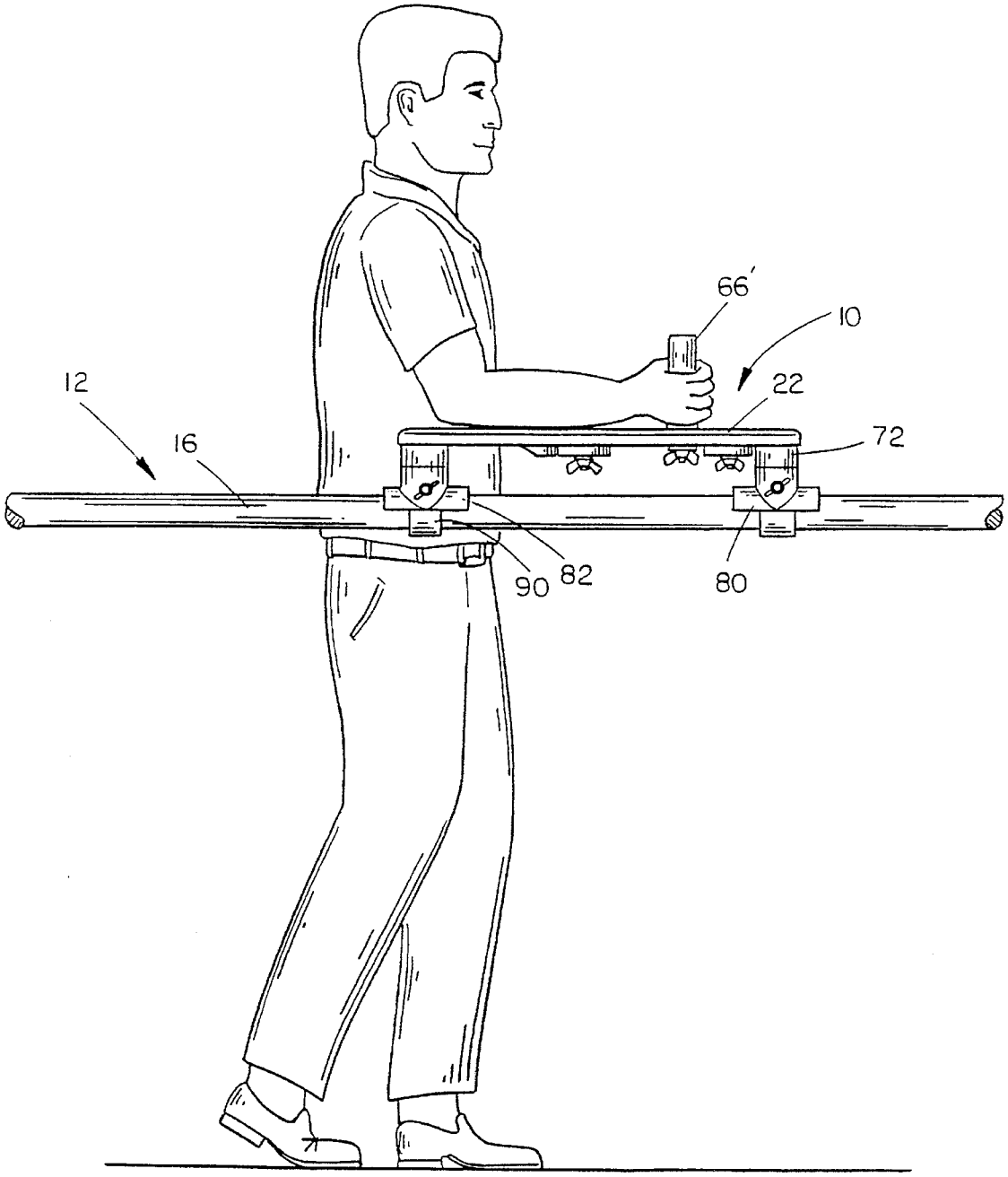
FIG. 1 is a side view of a patient utilizing the patient support of the present invention on parallel bars.

The patient support of this invention is referred to generally by the reference numeral 10 while the reference numeral 12 refers to a conventional set of parallel bars having bars 14 and 16. Support 10 includes a carriage 18 which may be mounted on the bars 14 and 16 as illustrated in the FIG. 1. Carriage 18 includes side frame members 20 and 22 having cross frame members 24 and 26 extending between them.

Figure 2:
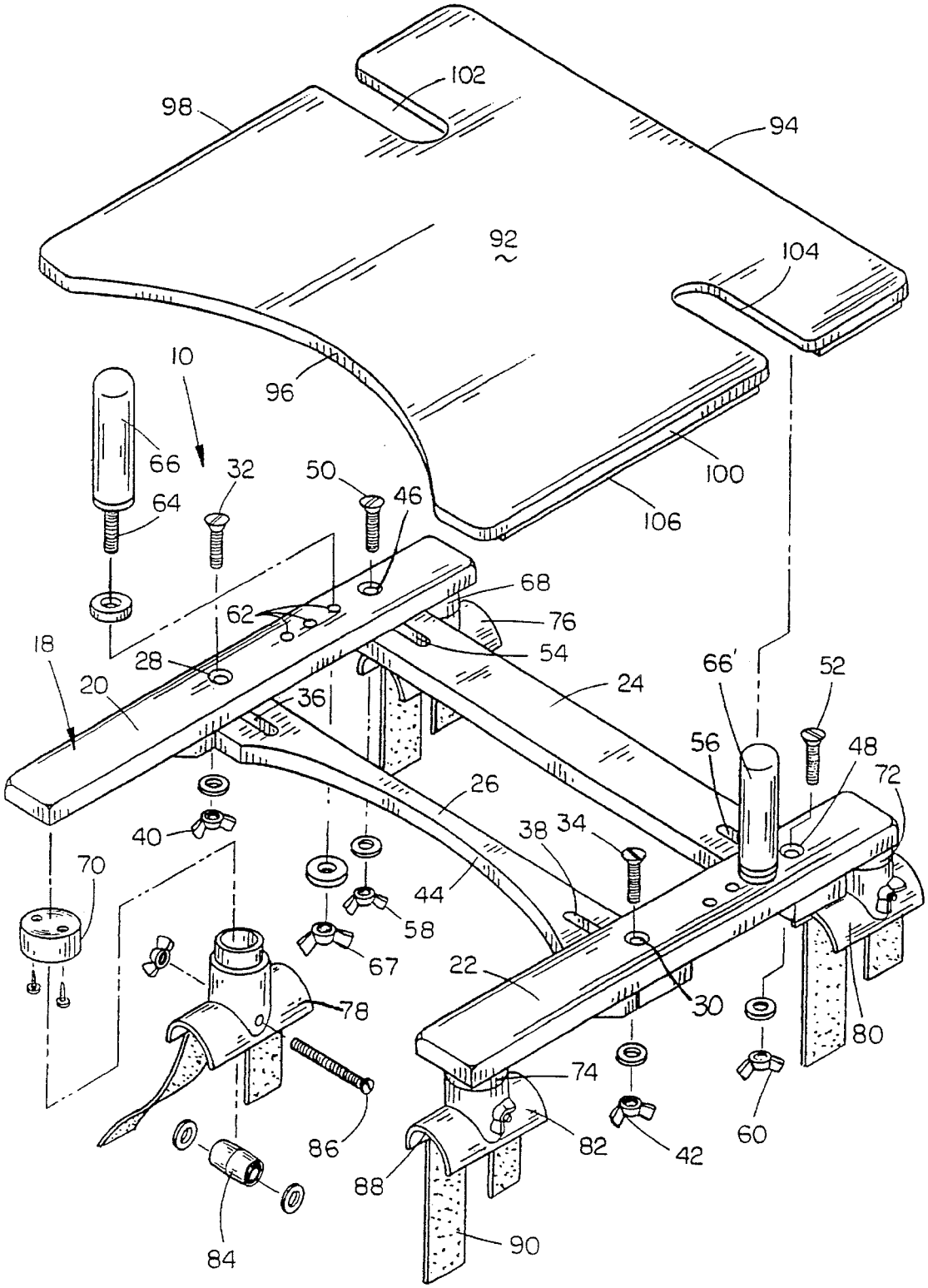
FIG. 2 is an exploded perspective view of the patient's support of the present invention.

As shown in FIG. 2, side frame members 20, 22 are provided with openings 28, 30 respectively which are adapted to receive carriage bolts 32, 34 which extend downwardly through the openings 28, 30 for reception by the slots 36, 38 formed in the frame member 26. Wing nuts 40, 42 are threadably mounted on the lower ends of the carriage bolts 32, 34 to connect the frame member 26 to frame members 20, 22. The elongated slots 36, 38 in frame member 26 enable the distance between the side frame members 20, 22 to be varied to compensate for different widths of parallel bars. Frame member 26 is provided with an arcuate cut-out portion 44 adjacent its rearward end to receive the patient's abdomen.

Frame members 20, 22 are provided with openings 46, 48 formed adjacent the forward ends of the frame members 20, 22 and adapted to receive carriage bolts 50, 52 which extend downwardly through the frame members 20, 22. The carriage bolts 50, 52 are adapted to be received by the elongated slots 54, 56 formed in frame member 24. Wing nuts 58, 60 are threadably received on the lower ends of bolts 50, 52 respectively to secure the frame member 24 to the frame members 20, 22. The elongated slots 54, 56 in frame member 24 permit the distance between the frame members 20, 22 to be varied to enable the device to accommodate various sizes and types of parallel bars.

Frame member 20 is provided with a plurality of openings 62 formed rearwardly of opening 46 which are adapted to receive the downwardly extending threaded portion 64 of handle 66. Handle 66 can be positioned in any of the openings 62 as desired to enable the device to be adjusted to accommodate persons having various lower arm lengths. Handle 66 is maintained in the opening 62 by means of the wing nut 67. Similarly, a handle 66' is provided on frame member 22.

Hollow cup-shaped collars 68, 70 are secured to the underside of frame member 20 at the forward and rearward ends as seen in FIG. 2. The collars 68, 70 are secured to the frame member 20 by means of screws or the like. Similarly, collars 72, 74 are secured to the underside of frame member 22 adjacent the forward and rearward ends. Collars 68, 70, 72 and 74 have the upper ends of T-shaped members 76, 78, 80 and 82 fictionally received on them so as to be selectively rotatable with respect to the respective collars. The upper ends of the T-shaped members 76, 78, 80 and 82 allow the collars 68, 70, 72 and 74 to be selectively rotatable about a vertical axis in relation to the carriage 18, providing a breaking mechanism for the carriage 18 as it moves along the bars 14, 16.

Figure 6:
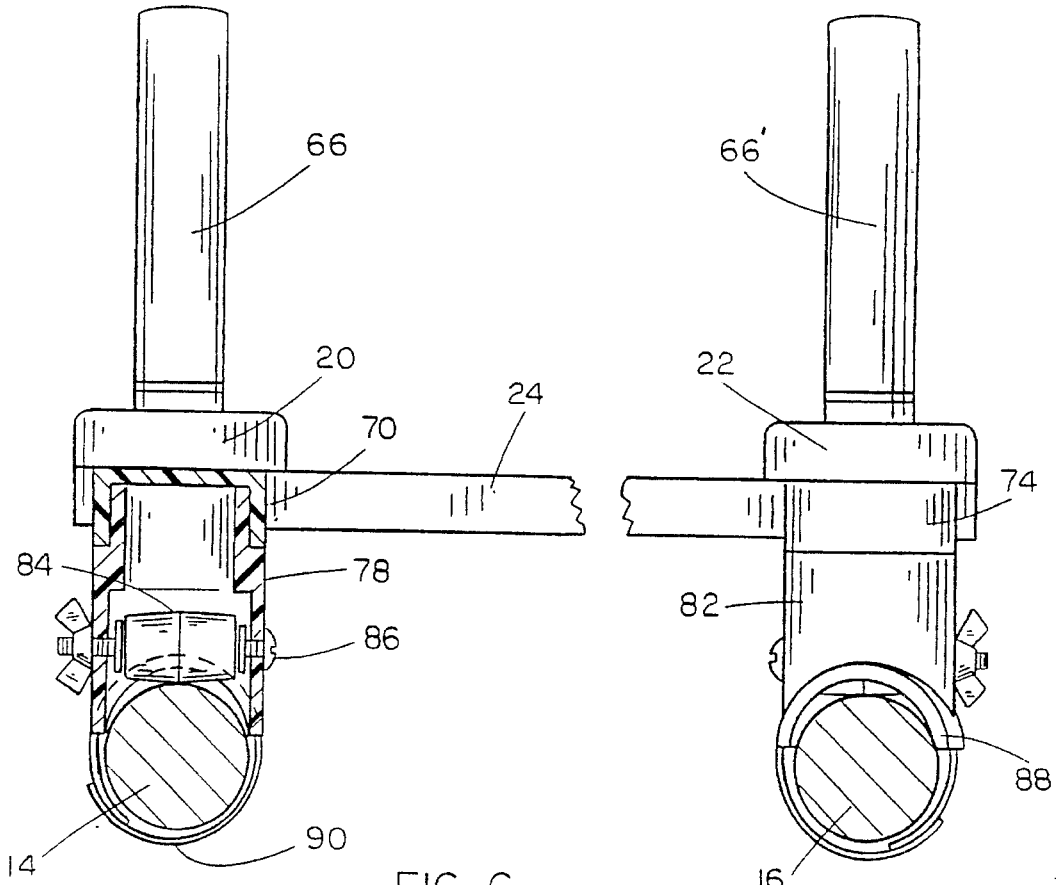
FIG. 6 is a partial sectional view illustrating the rollers located at the bottom of the carriage and the breaking mechanisms.
Figure 8:
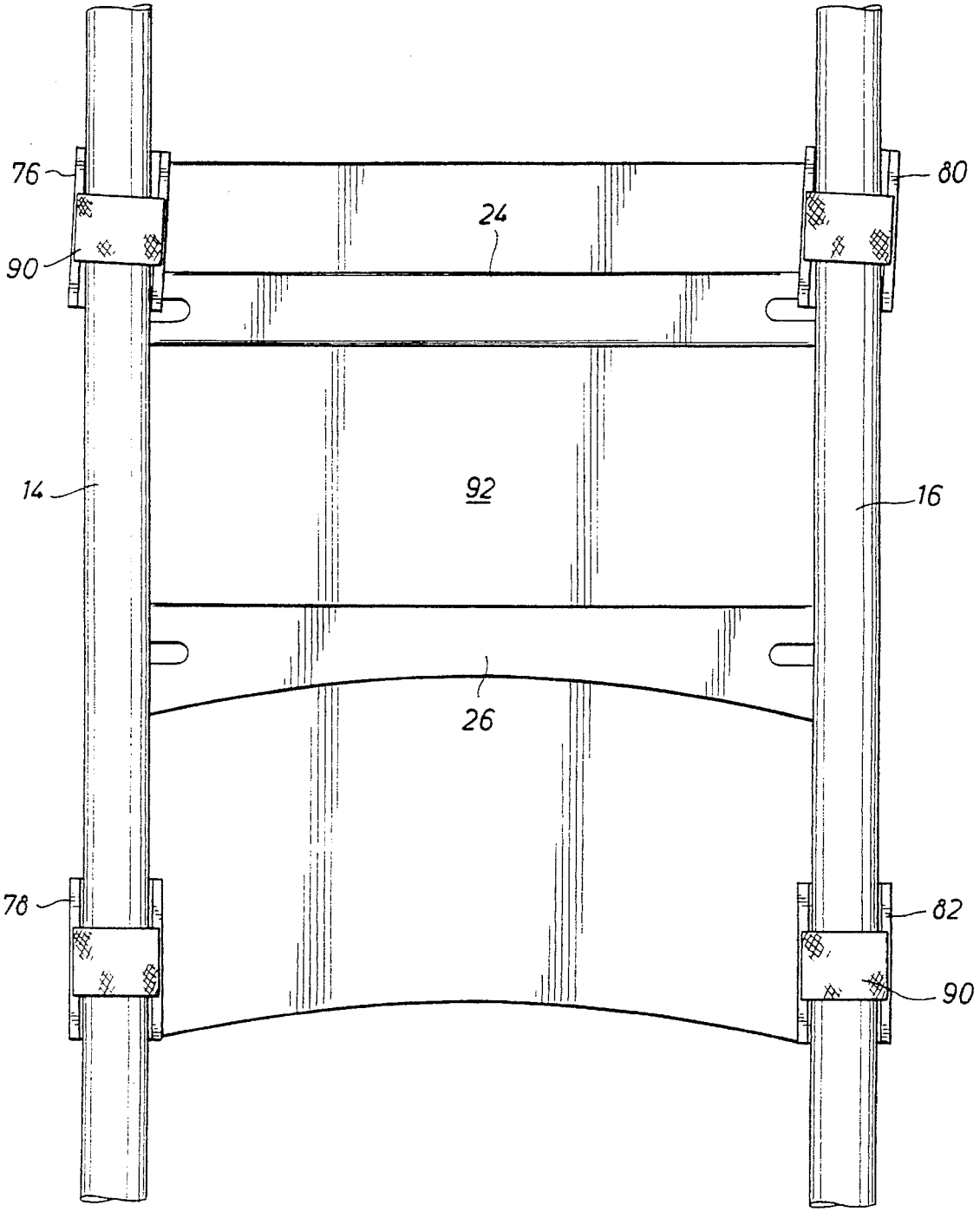
FIG. 8 is a partial sectional view of the underside of FIG. 3 illustrating the carriage guides in a rotated variation.

Each of the T-shaped members 76, 78, 80 and 82 is provided with an optional roller 84 mounted to it by means of a bolt 86. Although the device will perform satisfactorily without the rollers 84, it is preferred that the rollers 84 be utilized to engage the upper surface of the bars 14, 16 so that the support 10 will more smoothly glide upon the upper surface of the bars 14, 16. Without the roller 84, the arcuate portion 88 of the T-shaped member will slide or glide upon the upper surface of the bars. Velcro-type strap 90 is mounted on each of the T-shaped members 76, 78, 80 and 82 so that the straps may be extended around the bar as seen in FIG. 6 to prevent the apparatus from inadvertently becoming disengaged from the parallel bars 14, 16. The movement of the carriage 18 on the bars 14 and 16 may also be retarded or braked by rotating one or more of the T-shaped members 76, 78, 80 or 82 with respect to its associated bars 14, 16 so that the longitudinal axis of the T-shaped member will not be parallel to the parallel bar but will be canted with respect thereto as illustrated in the right hand portion of FIG. 6 so that the arcuate shape portion 88 of the T-shaped member will fictionally engage the bar as illustrated in FIGS. 6 and 8 to retard or brake the motion of the support 10 as it is being moved along the parallel bars 14, 16.

Figure 5:
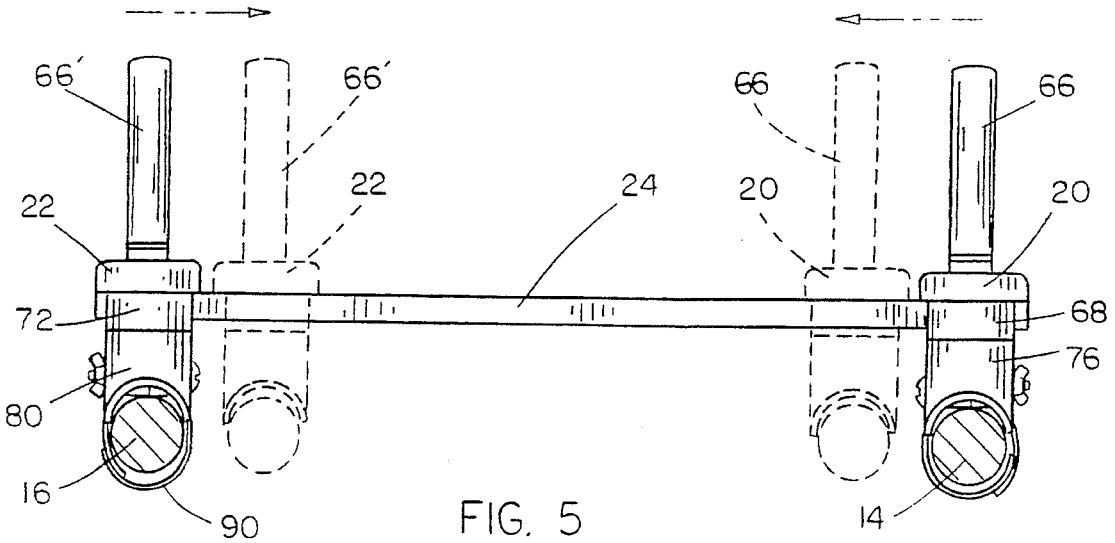
FIG. 5 is a rear view of the support illustrating the width adjustable features.

In use, the support 10 of this invention may be placed on the parallel bars 14, 16 with the velcro straps 90 being extended around it so that the support 10 will remain on the bars 14, 16. The width of the carriage may be adjusted as previously described to enable the device to fit different types of parallel bars such as illustrated in FIG. 5.

Figure 3:
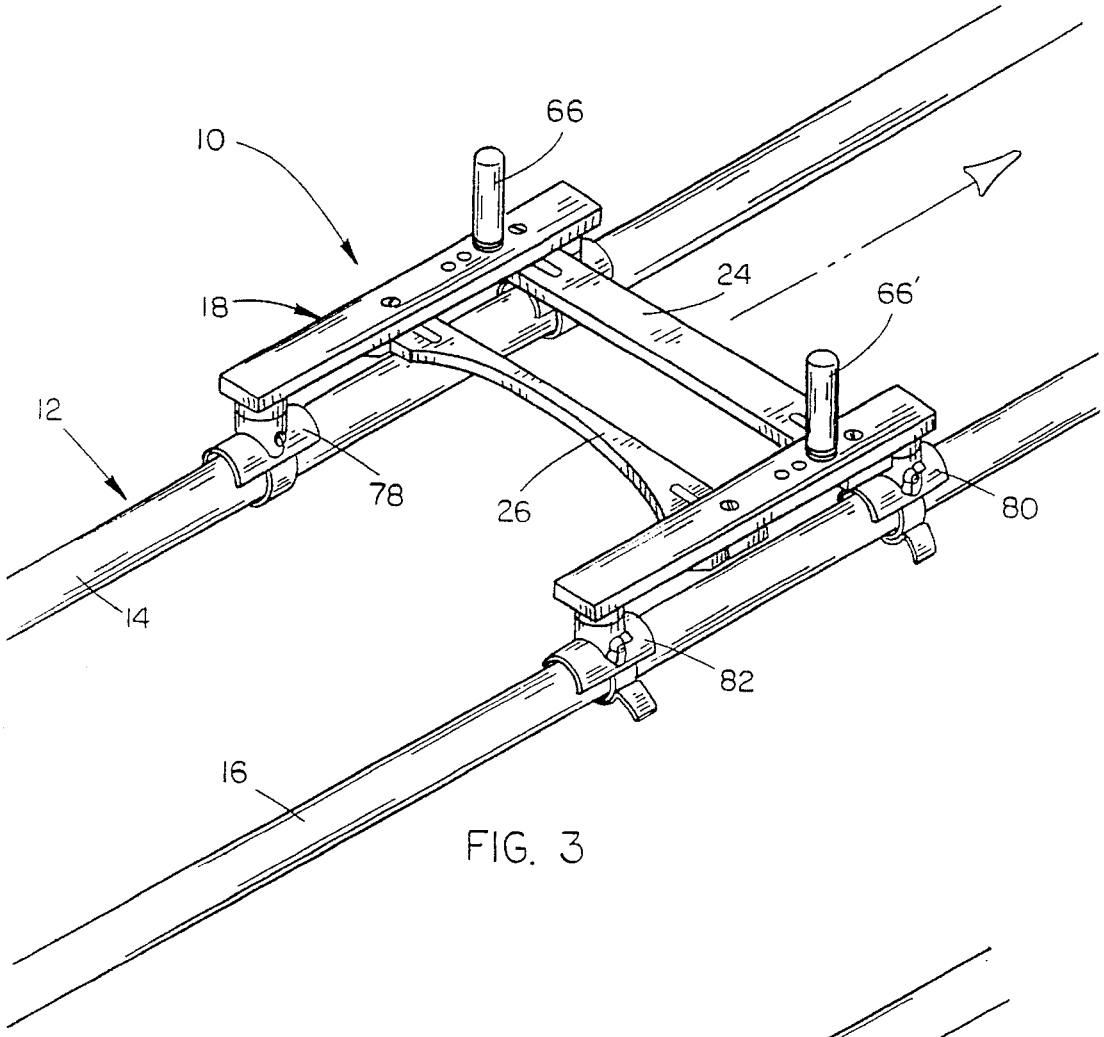
FIG. 3 is a rear perspective view of the patient's support mounted on parallel bars.
Figure 4:
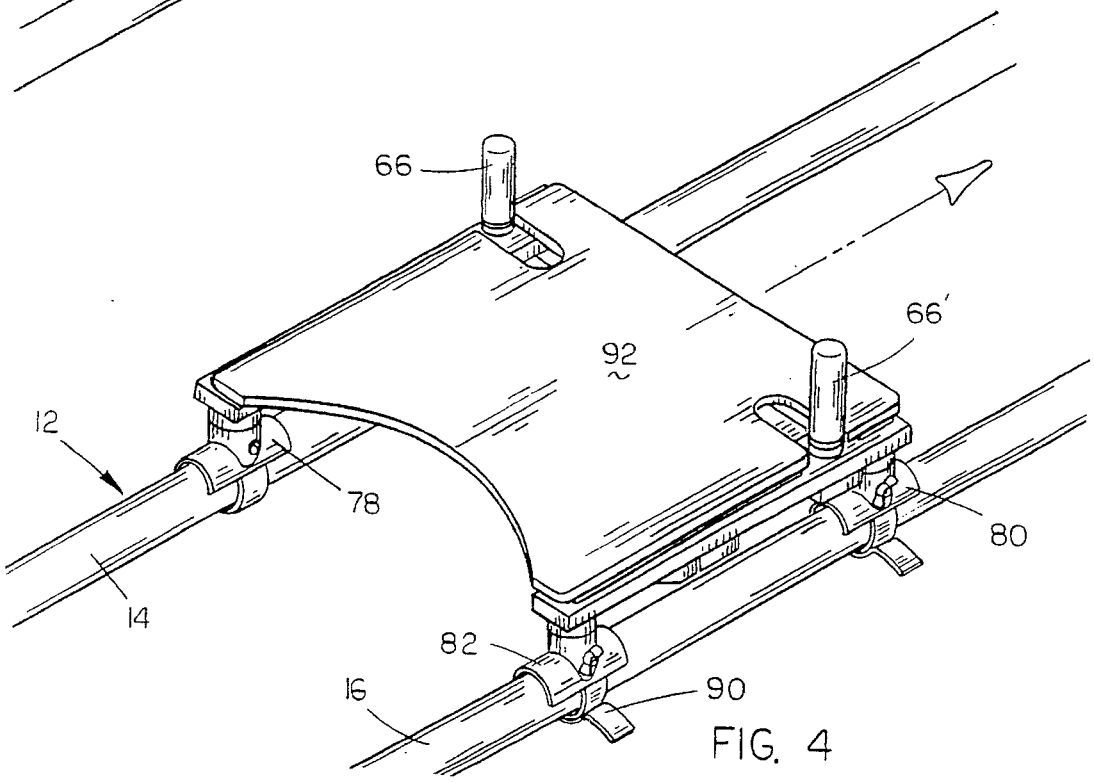
FIG. 4 is a view similar to FIG. 3 with the optional boarding board positioned on top of the carriage.

The handles 66, 66' can be placed in the proper holes 62 in the frame members 20, 22 so as to allow the patient to grasp the same while resting his or her arms on the frame members 20, 22 as illustrated in FIG. 1. The patient then walks between the parallel bars as illustrated in FIG. 1 with the support 10 providing the necessary support to the patient during the therapy or rehabilitation exercises. As stated, movement of the support 10 may be retarded or braked by simply rotating one or more of the T-shaped members 82 with respect to their respective collars to create additional contact between the T-shaped members and the parallel bars 14, 16. When using the support 10 as illustrated in FIG. 3, the patient is not only supported between the bars 14, 16 but is able to see the floor surface below. If the patient requires additional stability, an optional support board 92 is provided which can be positioned on the upper surface of the carriage 18. Board 92 includes a forward edge 94, arcuate rear edge 96, opposite side edges 98 and 100, and cut-outs 102, 104. Cut-outs 102, 104 are adapted to receive the handles 66, 66' as illustrated in FIG. 4.

Figure 7:
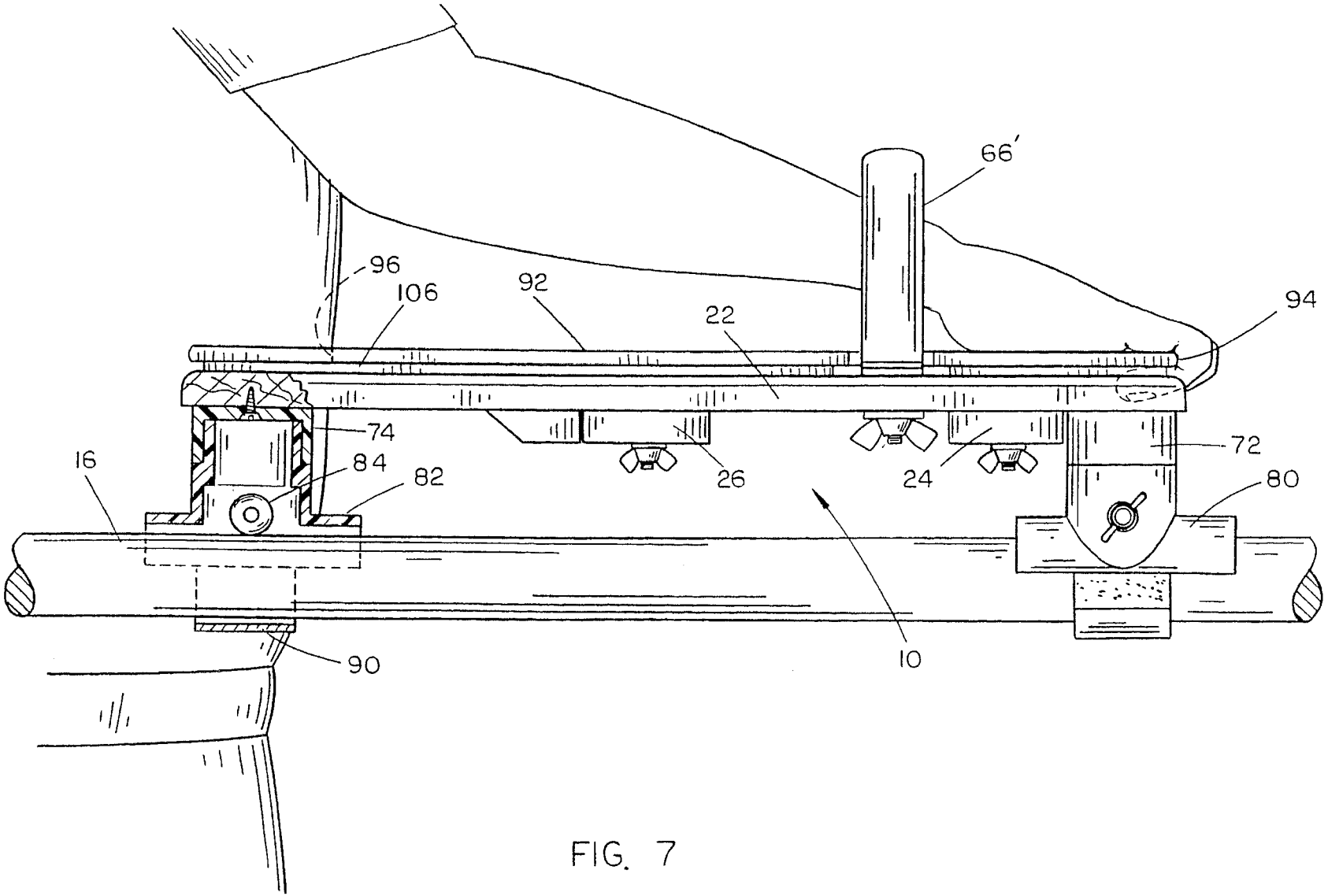
FIG. 7 is a side view similar to FIG. 1 with portions cut away to more fully illustrate the invention.

When the board 92 is being used, the patient may either grasp the handles 66 and 66' or the front edge 94 of the board, as shown in FIG. 7, to provide additional stability. The patient may also grasp the cut-outs 102 and 104 if desired. It is preferred that the underside of the board 92 be provided with elongated rubber strips 106 at its opposite sides for engaging with the upper surface of the frame members 20, 22 to prevent slippage of the board 92 with respect to the carriage 18, as shown in FIG. 7. The board 92 provides additional stability to the patient but it also limits the ability of the patient to be able to see the floor surface immediately below the support 10.

Figure 9:
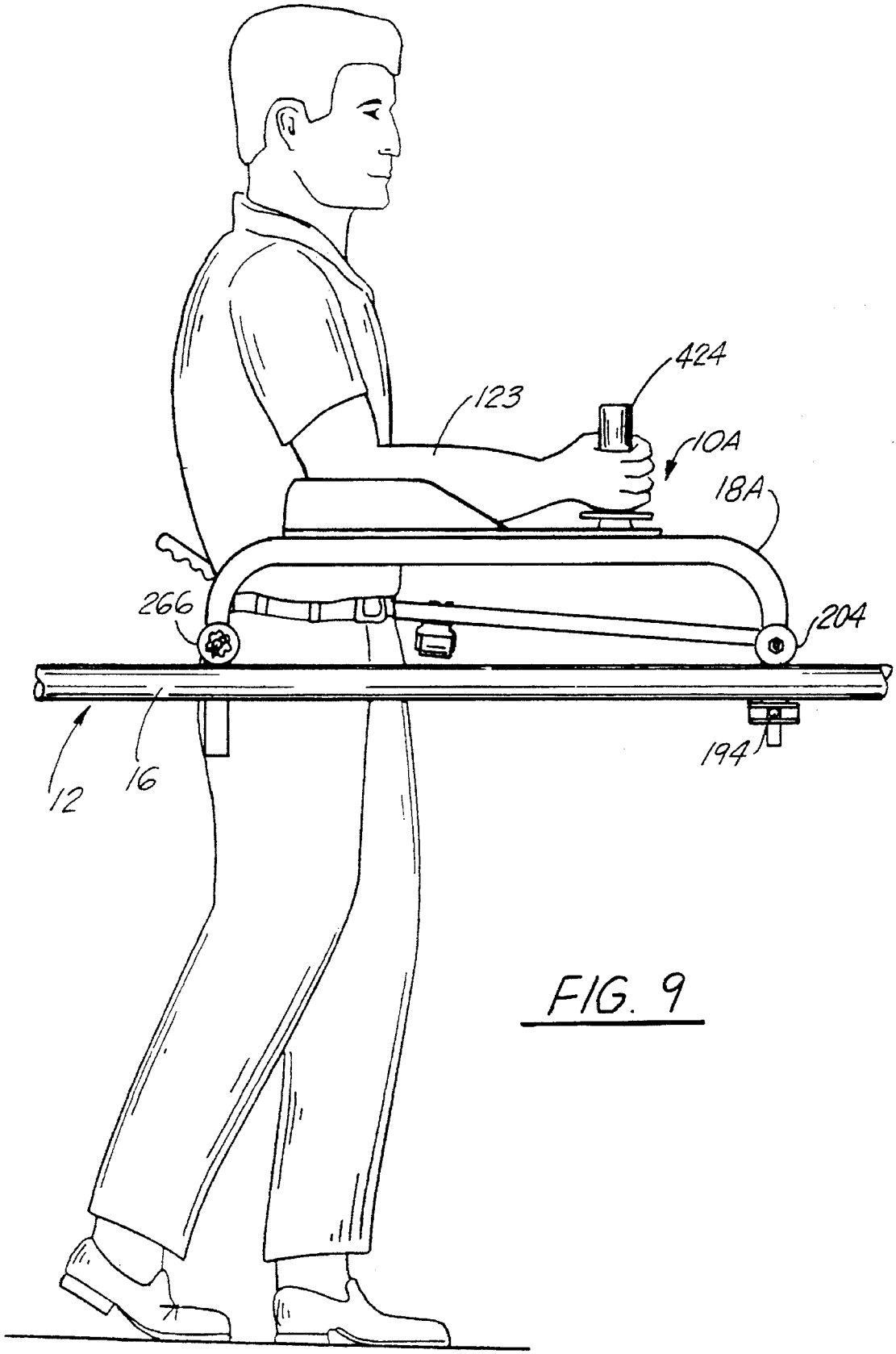
FIG. 9 is a side view of a patient using an alternate embodiment of the invention on parallel bars.
Figure 10:
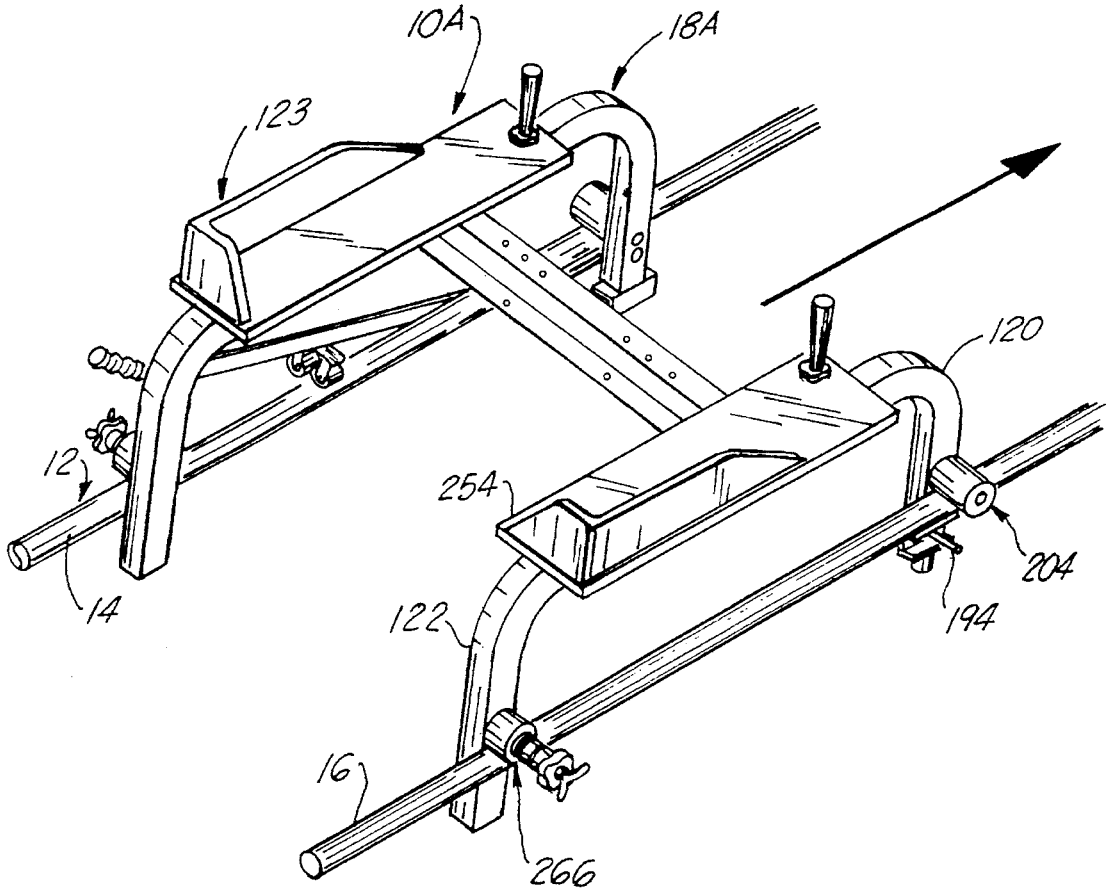
FIG. 10 is a rear perspective view of the alternate embodiment of the invention mounted on parallel bars.

An alternate embodiment of the invention, glider 10A, includes a carriage 18A which may be mounted on the parallel bars 14 and 16 as illustrated in FIG. 9 and 10. Carriage 18A includes a U-shaped front frame portion 120, a U-shaped rear frame portion 122, armrest assemblies 123 and handle assemblies 434. Wheel assemblies support and glide the frame portions 120, 122 along the upper surface of the parallel bars 12. The frame portions 120 and 122 include turned-down leg portions 120' and 122' respectively. The front frame portion 120 has a plurality of openings 124 for the insertion of threaded inserts 126 which receives the handle assemblies 434.

Figure 11:
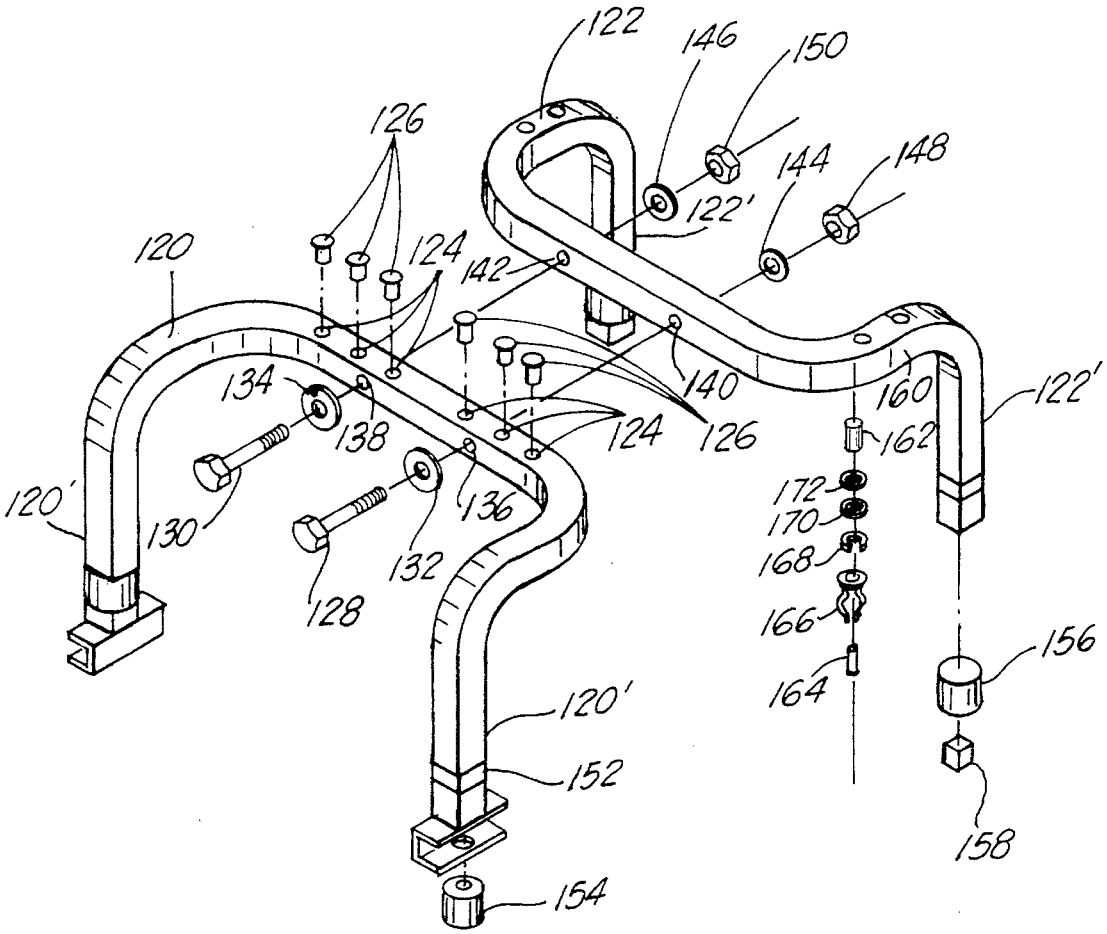
FIG. 11 is an exploded perspective view of the carriage portion of the alternate embodiment of the invention.

As shown in FIG. 11, carriage 18A is assembled by inserting bolts 128, 130 through washers 132, 134, openings 136, 138 of frame 120, through openings 140, 142 of frame 122, and washers 144, 146. Hex nuts 148, 150 are threaded onto the bolts 128, 130 for holding the front and rear frame portions 120, 122 together. Adhesive foam 152 is attached to the leg portions 120' and 122' of the frame portions 120 and 122. Split plastic circular tubes 154, 156 are attached over the adhesive foam 152 on the frame legs 120', 122'.

Plastic plugs 158 are inserted into the bottoms of the legs 122' of the rear frame portion 122. The rear frame portion 122 has an opening 160 on its underside for the insertion of a clip 166 for holding a brake handle in a raised position. A threaded insert 162 is placed in the opening 160 and the clip 166 is assembled by inserting a screw 164 through the clip 166, through a lock washer 168, a second washer 170, a third washer 172 and into the threaded insert 162.

The glider 10A includes a torque responsive horizontal bar mechanism that keeps the glider 10A in contact with the upper surface of the parallel bars 12 as the glider 10A is moved along the parallel bars 14 and 16. The horizontal bar mechanism has the ability to rotate out of the way as the glider 10A moves over the supports for the parallel bars and then to rotate back into position after the glider 10A moves past the bar supports.

Figure 12:
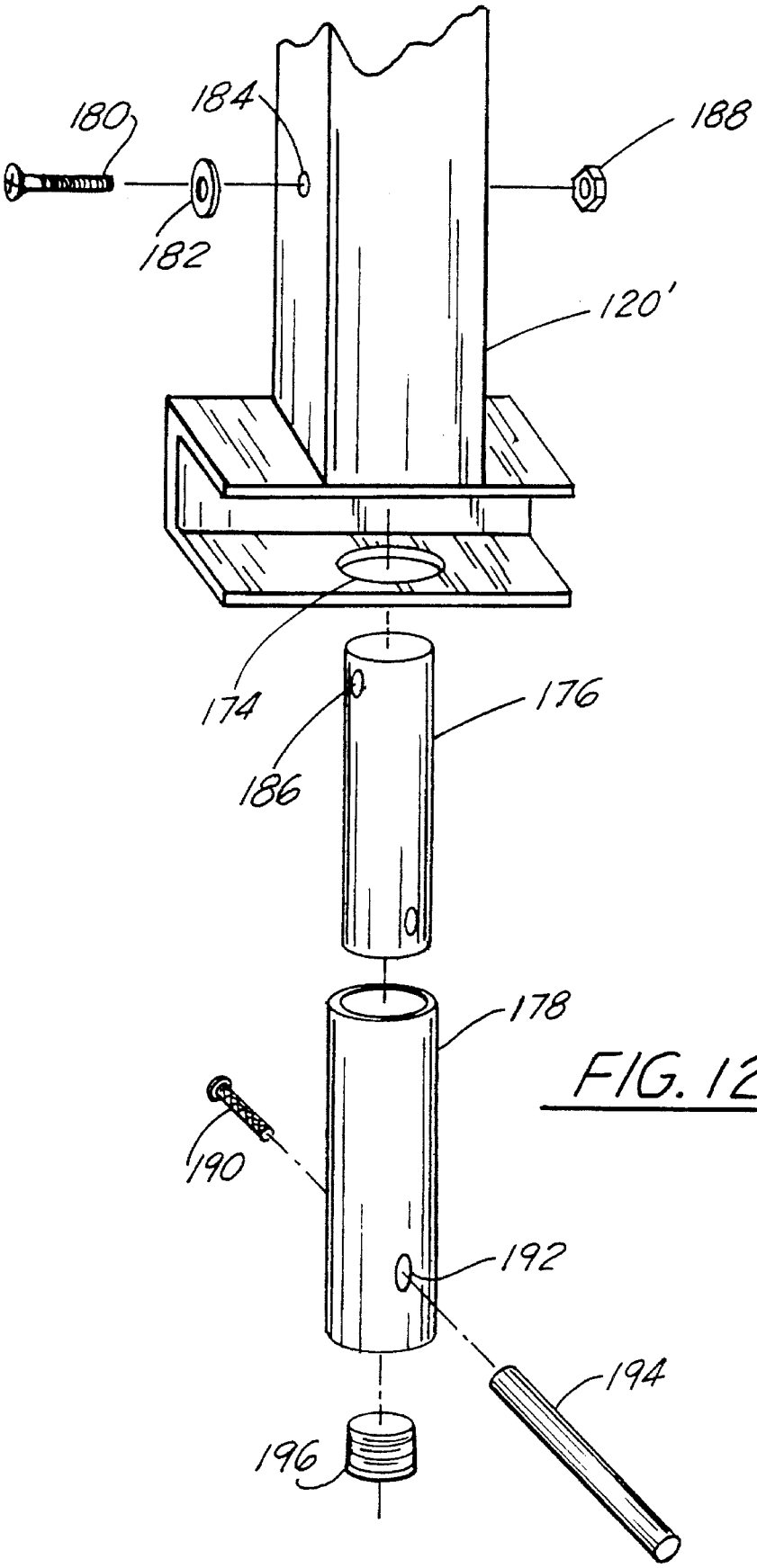
FIG. 12 is an exploded perspective view of the torque sensitive horizontal bar mechanism for holding the patient support to the upper surface of the parallel bars.

As shown in FIG. 12, the front legs 120' of the front frame portion 120 are provided with openings 174 that allow for the insertion of elastomeric cylinders 176 and tubular sections 178. A threaded fastener 180 is inserted through washer 182, through opening 184 in the leg 120' of the front frame portion 120, through opening 186 in the elastomeric cylinder 176, and fastened with a hex nut 188. A threaded fastener 190 is placed through opening 192 in the tubular section 178, and into the threads of a horizontal bar 194. An endcap 196 is placed into the downward end of tubular section 178. When the horizontal bar 194 hits the bar supports, the tubular section 178 rotates around the cylinder 176 moving the horizontal bar 194 out of the way. Once past the supports, the bar 194 rotates back into its original position.

Figure 13:
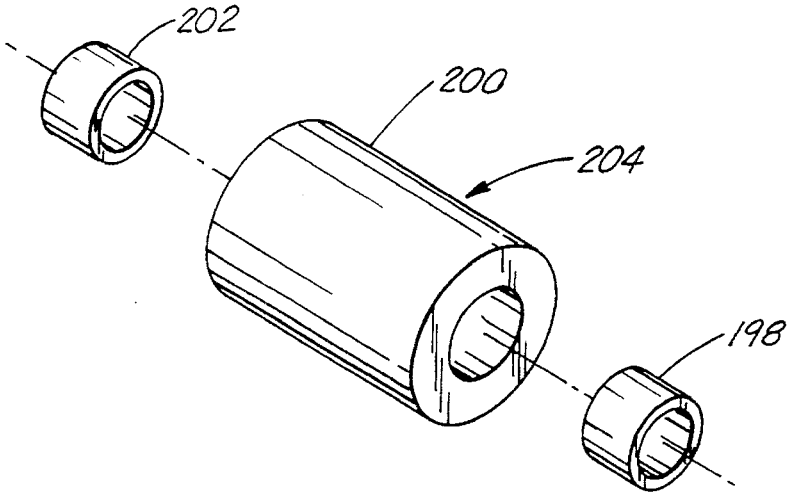
FIG. 13 is an exploded perspective view of the wheel assembly.
Figure 14:
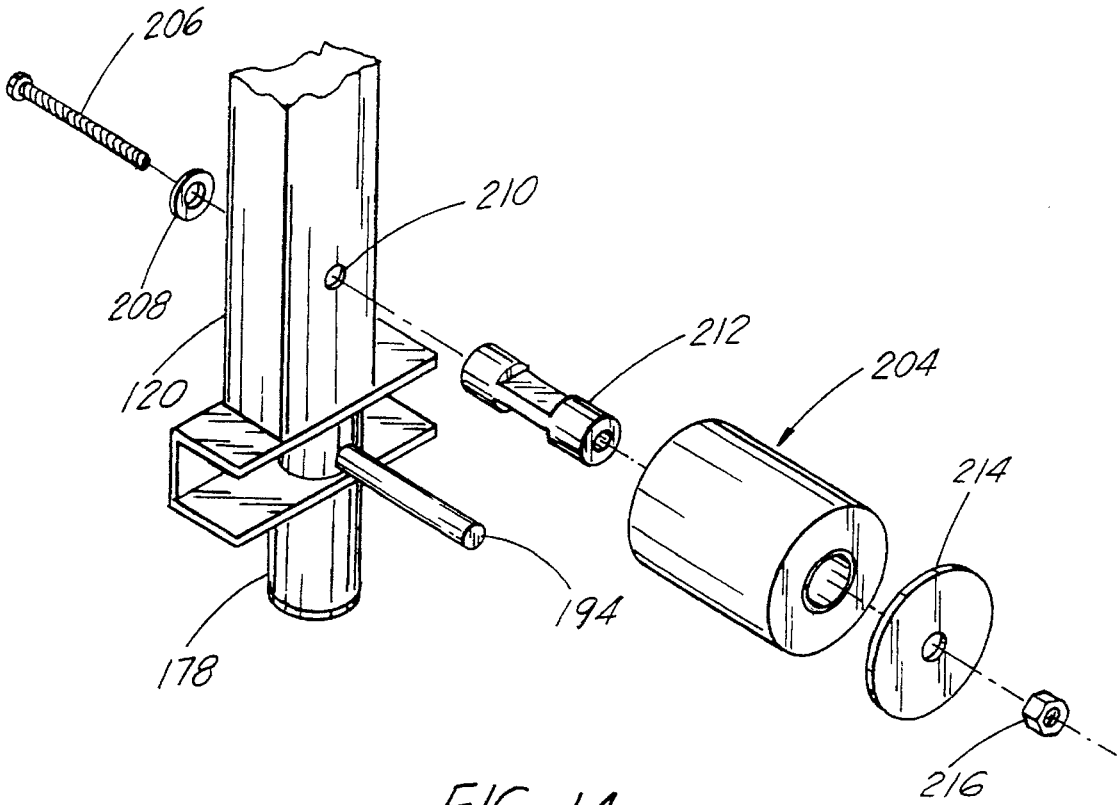
FIG. 14 is an exploded perspective view of the right front wheel assembly attached to the carriage portion of the alternate embodiment of the invention.

As shown in FIG. 13, a front right wheel assembly 204 is formed by first pressing a sleeve bearing 198, 202 into each end of an elastomeric tubular piece 200. Then, as shown in FIG. 14, a fastener 206 is threaded through washer 208, through opening 210 in the right leg portion 120' of the front frame portion 120, and through threaded machined part 212. Front wheel assembly 204 is inserted over machined part 212 and a fender washer 214 is placed over the end of fastener 206 adjacent to machined part 212. A hex nut 216 threads onto the end of fastener 206 adjacent the fender washer 214 for securing all of the numbered parts 206 to 216 together.

Figure 16:
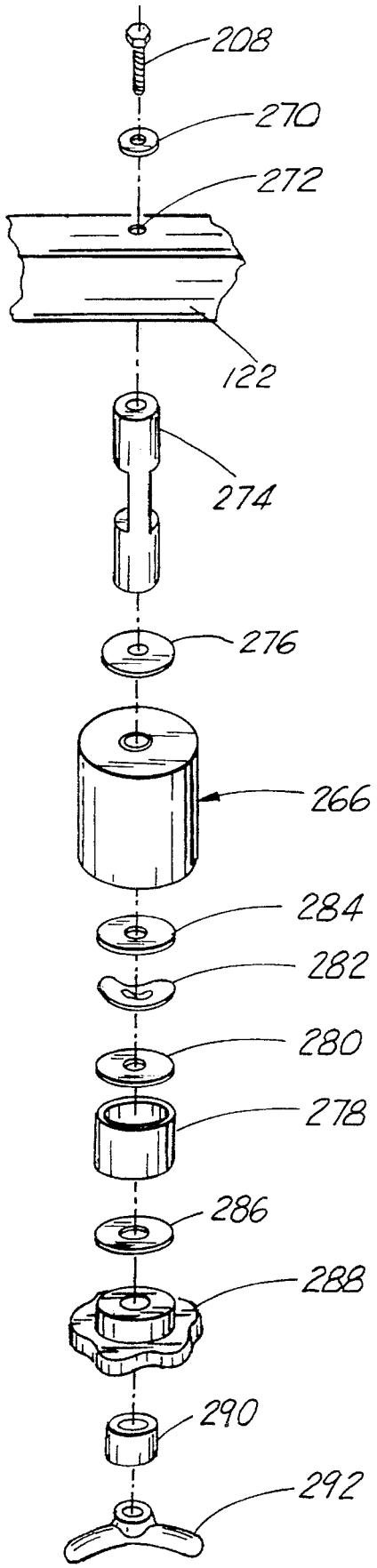
FIG. 16 is an exploded perspective view of the rear wheel resistance assembly attached to the carriage portion of the alternate embodiment of the invention.

The left and right rear wheels assemblies are similar to the right front wheel assembly 204, however, only a right rear wheel assembly 266, as shown in FIG. 16, will be described. Fastener 208 is placed through washer 270, through opening 272 in rear leg 122' of rear frame portion 122, and into a threaded opening in machined part 274. An elastomeric washer 276 is placed over machined part 274 adjacent to the rear frame portion 122 and a rear wheel assembly 266 is placed over machined part 274 adjacent to the elastomeric washer 276. A tubular piece 278, washer 280, curved spring 282, and washer 284 are placed over machined part 274 which extends through the wheel assembly 266. Washer 286 is placed over fastener 208 adjacent to tubular piece 278 and a rosette handle 288 is threaded onto the end of fastener 208. Tubular piece 290 is placed over the end of fastener 208 and into a recess of rosette handle 288. A wingnut 292 is then threaded onto the end of fastener 208 to hold the entire assembly together.

The wheel resistance of the glider 10A, as it moves along the parallel bars 12, can be varied by adjusting the rotational ability of the rear wheel assemblies as shown in the rear wheel assembly 266. This is achieved by tightening or loosening the wingnut 292 and rosette handle 288 which will alter the distance and thus, the rotational movement between the parts that make up the entire rear wheel assembly 266 as shown in FIG. 16.

Figure 17:
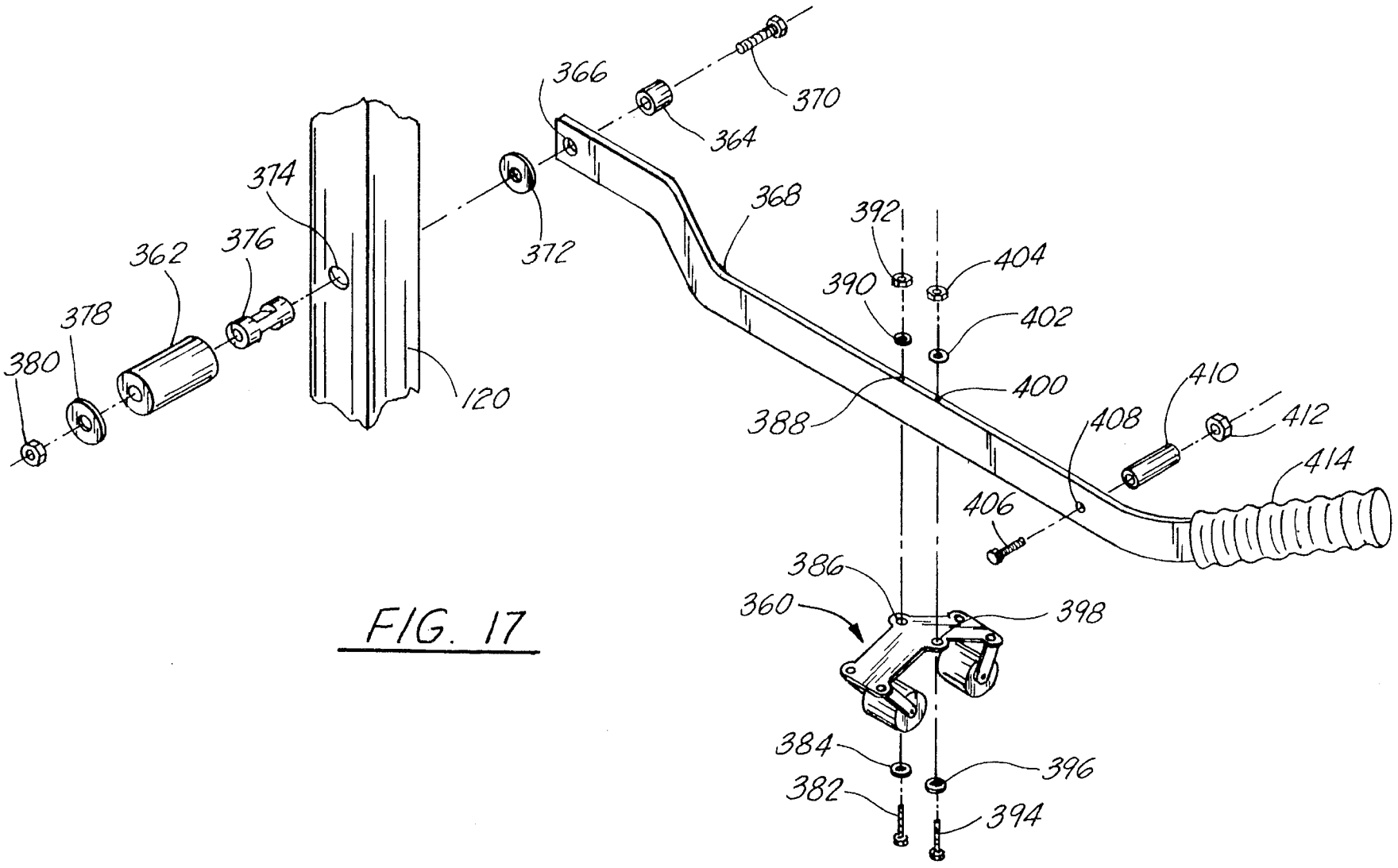
FIG. 17 is an exploded perspective view of the brake arm assembly attached to the carriage portion of the alternate embodiment of the invention.

A assembly similar to the right front wheel assembly 204 is also used for a left front wheel assembly 362 and is shown in FIG. 17. A bushing 364 is inserted into opening 366 on a brake arm 368 and a threaded fastener 370 is placed through the brake arm 368 and through washer 372. The fastener 370 is then inserted through opening 374 in the front left leg 120' of front frame portion 120 and through a machined part 376. A left front wheel assembly 362 is placed over machined part 376 and a fender washer 378 is placed on the end of fastener 370 adjacent to machined part 376. A hex nut 380 is threaded onto the end of fastener 370 to hold the entire assembly together.

Figure 18:
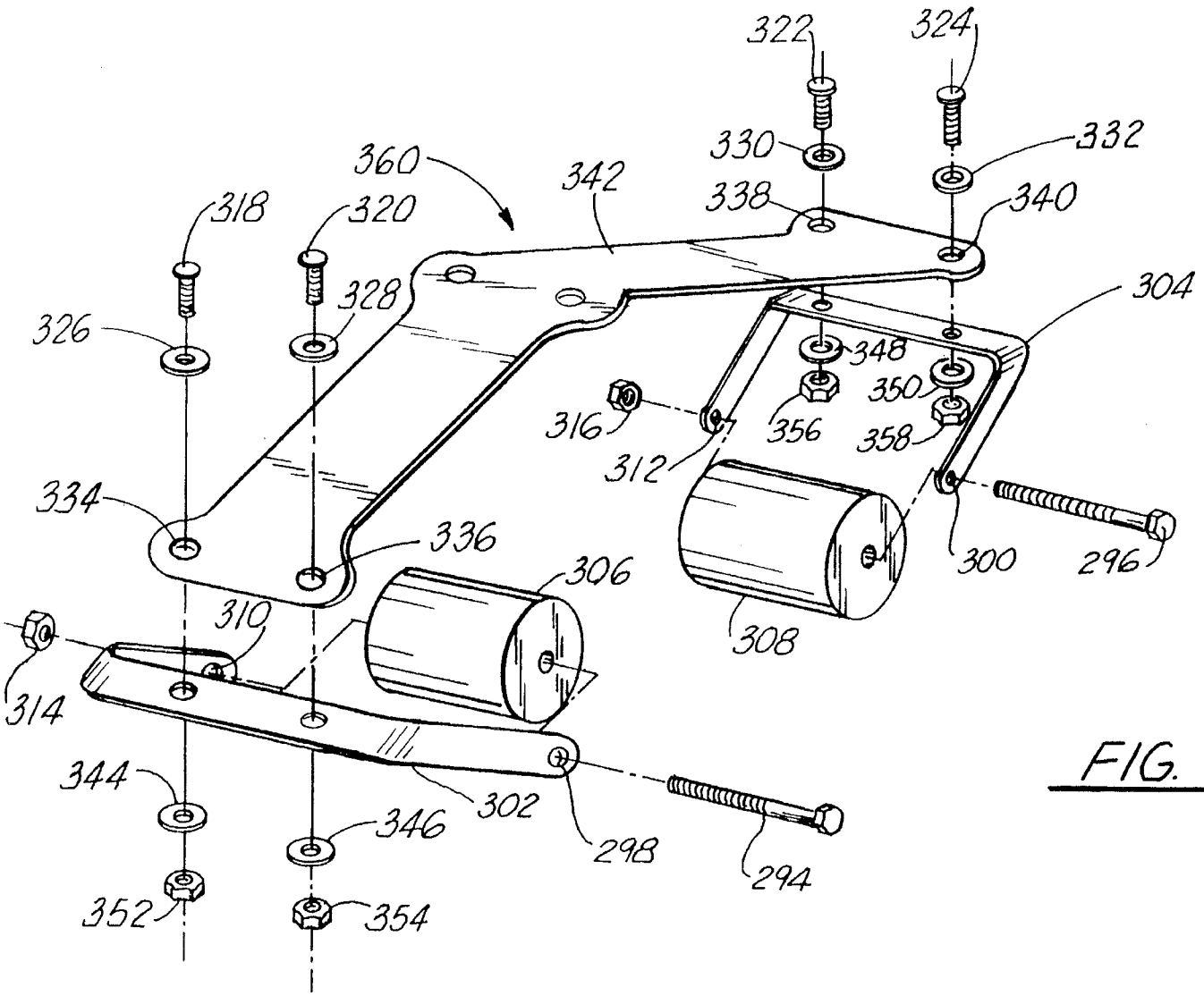
FIG. 18 is a perspective view of the brake wheel assembly of the alternate embodiment of the invention.

A brake wheel assembly 360, illustrated in FIG. 18, is used as a separate braking mechanism for the glider 10A. Threaded fasteners 294, 296 are placed through openings 298, 300 in wheel holders 302 and 304, through the openings in wheels 306 and 308, through opposite holes 310, 312 in wheel holders 302 and 304, and into hex nuts 314, 316 respectively. Threaded fasteners 318, 320, 322, and 324 are placed through washers 326, 328, 330, and 332, through openings 334, 336, 338, and 340 on a brake spring 342, through washer 344, 346, 348, and 350, and into hex nuts 352, 354, 356, and 358. The entire assembly of parts 294 through 358 is referred to as the brake wheel assembly 360.

The brake wheel assembly 360 is attached to the brake arm 368 as shown in FIG. 17. A threaded fastener 382 is placed through washer 384, through an opening 386 on the brake wheel assembly 360, through opening 388 in the brake arm 368, through washer 390, and is secured by a hex nut 392 threaded over the fastener 382. A second threaded fastener 394 is placed through a rubber bumper 396, through opening 398 on brake wheel assembly 360, through opening 400 in brake arm 368, through washer 402, and is secured by a hex nut 404 threaded over the fastener 394. The brake arm 368 is used to raise and lower the brake wheel assembly 360 on the parallel bar 14. When the brake wheel assembly 360 is clamped over the parallel bar 14 it provides total immobility to the glider 10A and prevents it from being moved along the parallel bars 12.

The brake arm 368 is held in a raised non-braking position by snapping an outwardly extending tubular piece 410 attached to the brake arm 368 into the clip 166 in the left rear frame portion 122. As shown in FIG. 17, the tubular piece 410 is attached to the brake arm 368 by a threaded fastener 406 which is placed through opening 408 in the brake arm 368, through the tubular piece 410, and threaded into a hex nut 412. A rubber grip 414 is fictionally held in place over the upwardly bent end of the brake arm 368.

Velcro™ hook strips 416 and 418 are adhesively placed on the top and bottom portions of the crossbar or middle section of the rear frame portion 122 as illustrated in FIG. 19. A padding 420 of hook receptive material is placed onto the Velcro™ hook strips 416 and 418 for patient protection.

Figure 15:
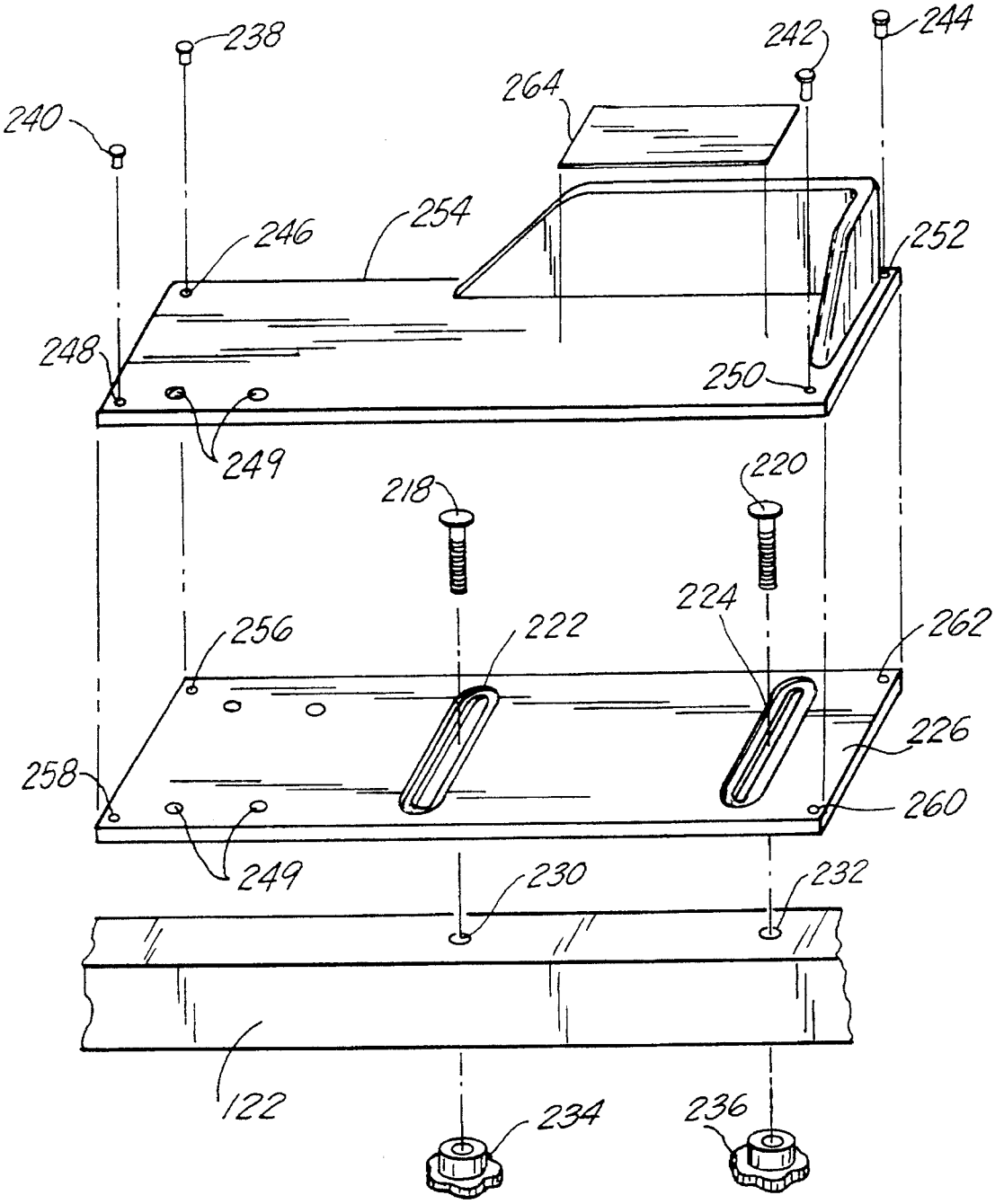
FIG. 15 is an exploded perspective view of the right adjustable armrest attached to the carriage portion of the alternate embodiment of the invention.

The armrest assembly 123 is illustrated in FIG. 15 and is assembled in the same way for both the left and right sides, however, only the right side will be described. Carriage bolts 218, 220 are threaded through elongated slots 222, 224 formed in an armrest plate 226, then through openings 230, 232 in the rear frame portion 122, and into the threaded portion of rosette knobs 234, 236. Fasteners 238, 240, 242, and 244 are placed through openings 246, 248, 250, 252 in a plastic armrest covering 254, and then inserted into threaded openings 256, 258, 260, and 262 respectively in the armrest plate 226. Adhesive foam 264 is placed on the upper surface of the plastic armrest covering 254 in order to provide padding for a patient's arms.

As illustrated in FIG. 20, the handle assembly 434 is assembled by threading a portion of a bent threaded rod 422 into the receiving threads in a handle 424. A clear tubular piece 426 is placed over a portion of the threads of the bent rod 422 and a rosette handle 428 is threaded onto the opposite end of the bent rod 422 after the handle 424 is positioned on the armrest 123 or the frame portion 120.

The plurality of openings 124 containing threaded inserts 126 on the front frame portion 120 are adapted to receive the downwardly extending threaded portion 422 of handle assembly 434. The armrest plate 226 and covering 254 also contain threaded openings 249 adapted to receive the downwardly extending threaded portion 422 of handle assembly 434. As shown in FIG. 21, the handle assembly 434 can be positioned in any of the threaded inserts 126 in the front frame portion 120, or the threaded openings 249 in the armrest plate 226 and covering 254 in order to allow the carriage 18A to be adjusted to accommodate persons having various lower arm lengths.

Figure 22:
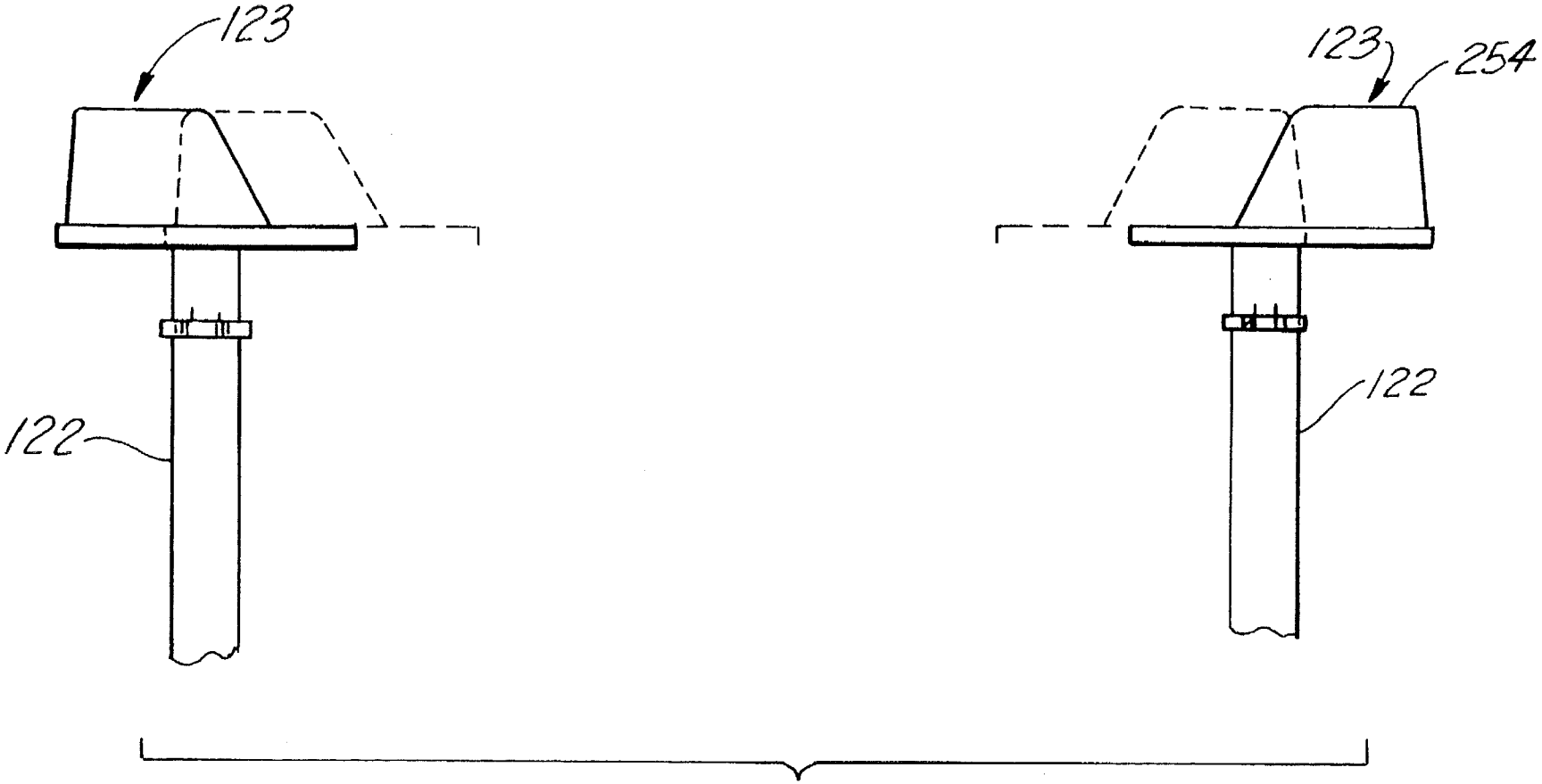
FIG. 22 is a rear view of the support illustrating the width adjustable features of the armrest upon the carriage portion of the alternate embodiment of the invention.

As shown in FIG. 22, the elongated slots 222, 224 in the armrest plates 226 allow the armrest assembly 123 to slide on the upper surface of the carriage 18A in a transverse direction. This allows the vertical distance between the armrests, relative to the parallel bars 14, 16, to be varied in order to accommodate the various sizes of patients.

Thus it can be seen that a novel patient support or glider has been provided for use with parallel bars which enables the patient to be supported between the parallel bars during therapy or rehabilitation exercises. The invention includes means to inhibit or retard the movement of the support or glider with respect to the parallel bars when in use. The support or glider of this invention is also convenient to use and provides the patient with the stability necessary for therapy or rehabilitation that takes place on parallel bars.

Although the present invention has been described with reference to its preferred embodiments, those skilled in the art will recognize changes which may be made in form or structure which do not depart from the spirit of the invention already described in the specification and embodied in the claims which follow.

What is claimed is:

1. A patient support for use with first and second horizontally spaced apart parallel bars, the bars being elevated above a walking surface that is engaged by a patient's feet, with the bars being elevated to a position adjacent a patient's torso, comprising:

(a) a carriage having a front and back end, front and back U-shaped frames having turned-down leg portions, the front and back frames being attached at a center portion of the U-shape, and opposite armrest portions placed along a portion of the front and back frames;

(b) a plurality of guide means placed on the turned-down leg portions of the front and back frames of the carriage for movably mounting the carriage on the parallel bars;

(c) the carriage having a configuration that allows the patient to position his or her torso between the parallel bars at the back end of the carriage and support him or herself by grasping the carriage and moving it along the parallel bars while the patient's feet engage the walking surface below the elevated bars; and (d) a manually operable braking means attached to a portion of the carriage for providing a selective braking of the carriage as it moves along the parallel bars, the braking means including means for rigidly securing the carriage to at least one of the first or second parallel bars.

2. The patient support of claim 1, wherein the guide means includes a plurality of wheels and horizontal bars positioned on a portion of the turned-down leg portions of the front and back frames, each wheel and bar being spaced apart from each other so as to allow the guide means to partially surround a portion of the first and second parallel bar, with each wheel being positioned so as to roll upon an upper portion of the parallel bars and each horizontal bar being positioned on the leg portions of the front frame so as to engage a lower portion of the parallel bars.

3. The patient support of claim 2, wherein at least one of the wheels of the guide means is capable of rotational adjustment so as to vary the wheel resistance of the carriage as it rolls upon the upper portion of the parallel bars.

4. The patient support of claim 1, wherein the armrest portions are positioned on a portion of the front and back frames so as to be in parallel alignment with the parallel bars when the carriage is mounted upon the parallel bars.

5. The patient support of claim 1, wherein a pair of upstanding handles are selectively adjustably mounted to the armrest portions.

6. The patient support of claim 5, wherein the armrest portions have a front and back end with the handles being positioned adjacent the front end of the armrest portions.

7. The patient support of claim 1 wherein the armrest portions have means for adjustments in a transverse plane along a portion of the from and back frames relative to the parallel bars.

8. A patient support for use with first and second horizontally spaced apart parallel bars, each parallel bar having end portions, the bars being elevated above a walking surface that is engaged by a patient's feet, with the bars being elevated to a position adjacent a patient's torso, comprising:

(a) a carriage having a front and back end, front and back U-shaped frames having turned-down leg portions, the front and back frames being attached at a center portion of the U-shape, and opposite armrest portions placed along a portion of the front and back frames;

(b) a plurality of guide means placed on the turned-down leg portions of the front and back frames of the carriage for movably mounting the carriage on the parallel bars so that the carriage can travel on the bars and between the end portions of the bars;

(c) the carriage having a configuration that allows the patient to position his or her torso between the parallel bars at the back end of the carriage and support him or herself by grasping the armrest portions with the patient's arms, the carriage and the bars defining a load bearing structure that allows the patient to support a portion of his or her weight while moving the carriage along the parallel bars when engaging the walking surface below the elevated bars with his or her feet;

(d) the carriage further including supports for receiving hands, forearms and elbows of a patient so that the patient can rest his or her hands, forearms and elbows on the supports and support him or herself while moving the carriage along the parallel bars; and (e) a manually operable braking means attached to a portion of the carriage for providing a selective braking of the carriage as it moves along the parallel bars, the braking means including means for rigidly securing the carriage to at least one of the first or second parallel bars.

* * * * *